US009925551B2

(12) United States Patent
Bettini

(10) Patent No.: US 9,925,551 B2
(45) Date of Patent: Mar. 27, 2018

(54) DEVICE TO PREVENT THE DRYING OF NOZZLES OF A MACHINE FOR THE PREPARATION OF FLUID COLORING PRODUCTS

(71) Applicant: COROB S.P.A. CON SOCIO UNICO, San Felice Sul Panaro (IT)

(72) Inventor: Marcello Bettini, Cento (IT)

(73) Assignee: COROB S.P.A. CON SOCIO UNICO, San Felice Sul Panaro (IT)

( * ) Notice: Subject to any disclaimer, the term of this patent is extended or adjusted under 35 U.S.C. 154(b) by 3 days.

(21) Appl. No.: 14/415,721

(22) PCT Filed: Jul. 16, 2013

(86) PCT No.: PCT/IB2013/001544

§ 371 (c)(1),
(2) Date: Jan. 19, 2015

(87) PCT Pub. No.: WO2014/013315

PCT Pub. Date: Jan. 23, 2014

(65) Prior Publication Data

US 2015/0158045 A1 Jun. 11, 2015

(30) Foreign Application Priority Data

Jul. 20, 2012 (IT) ..... UD2012A0132

(51) Int. Cl.
*B65B 1/04* (2006.01)
*B05B 15/02* (2006.01)
(Continued)

(52) U.S. Cl.
CPC ..... *B05B 15/02* (2013.01); *B01F 13/1055* (2013.01); *B67C 7/00* (2013.01);
(Continued)

(58) Field of Classification Search
CPC ..... B01F 13/1055; B01F 2215/0031; B05B 15/02; B05B 15/025; B67C 3/001;
(Continued)

(56) References Cited

U.S. PATENT DOCUMENTS 4,469,148 A * 9/1984 Vogele ..... B65B 39/002 141/87
5,784,854 A * 7/1998 Mazzalveri ..... B67B 7/24 141/329

(Continued)

FOREIGN PATENT DOCUMENTS

EP 0095181 A2 11/1983
EP 0779241 A1 6/1997

(Continued)

OTHER PUBLICATIONS

International Search Report for PCT/IB2013/001544 (dated Nov. 2013), 3 pages.

*Primary Examiner* — Alexander Valvis
(74) *Attorney, Agent, or Firm* — Flaster/Greenberg P.C.

(57) ABSTRACT

A device to prevent the drying of nozzles of a machine for the preparation of fluid coloring products having a delivery head includes an anti-drying member and an actuation mechanism to take the anti-drying member from an inactive position distant from the delivery head to an operating position in contact with the delivery head. The actuation mechanism includes an actuation lever oscillating with respect to a fixed support and a group of parallelogram levers commanded by the actuation lever and connected to the anti-drying member so as to keep an upper surface of the anti-drying member constantly parallel to the lower surface of the delivery head during the movement from the inactive position to the operating position.

20 Claims, 6 Drawing Sheets

(51) Int. Cl.
*B67C 7/00* (2006.01)
*B01F 13/10* (2006.01)
*B67B 7/00* (2006.01)

(52) U.S. Cl.
CPC ..... *B67C 7/008* (2013.01); *B67C 7/0073* (2013.01); *B67C 7/0086* (2013.01); *B67B 7/24* (2013.01)

(58) Field of Classification Search
CPC ..... B67C 3/002; B67C 3/004; B67C 7/0073; B67C 7/008; B67C 7/0086; G01N 35/1004; B67D 1/07

USPC ..... 222/144, 144.5; 239/104, 106; 141/89, 141/90, 104

See application file for complete search history.

(56) References Cited

U.S. PATENT DOCUMENTS

| | | | | |
|---|---|---|---|---|
| 5,842,641 | A | 12/1998 | Mazzalveri | |
| 7,163,037 | B2 * | 1/2007 | Walkowski | B60K 15/0406 141/350 |
| 7,228,879 | B2 * | 6/2007 | Miller | B05B 15/02 141/271 |
| 7,581,571 | B2 * | 9/2009 | Hsing | B67D 1/0887 137/313 |
| 8,352,070 | B2 * | 1/2013 | Bartholomew | A45D 29/00 700/233 |
| 2008/0223480 | A1 | 9/2008 | Hsing | |

FOREIGN PATENT DOCUMENTS

| | | | |
|---|---|---|---|
| EP | 0911085 | A1 | 4/1999 |
| EP | 1510260 | A1 | 3/2005 |
| FR | 2867768 | A1 | 9/2005 |
| IT | UD2012A000126 | | 1/2014 |
| WO | WO 01/75586 | A1 | 10/2001 |
| WO | WO 2005/107956 | A1 | 11/2005 |
| WO | WO 2006/106102 | A2 | 10/2006 |
| WO | WO 2011/161532 | A1 | 12/2011 |

* cited by examiner

DEVICE TO PREVENT THE DRYING OF NOZZLES OF A MACHINE FOR THE PREPARATION OF FLUID COLORING PRODUCTS

BACKGROUND OF THE INVENTION

Field of the Invention

The present invention concerns a device to prevent the drying of nozzles of a machine for the preparation of fluid coloring products. Typically, the device according to the present invention is applied in machines, also called dispensers, which use a delivery head provided with a plurality of nozzles, to selectively dispense defined quantities of coloring agents, or pigments, for example liquids, into a base product for paints, varnishes, enamels, inks or suchlike, contained in a receptacle, and to thus obtain a finished product with a desired shade of color.

Description of Related Art

In the field of machines for preparing fluid coloring products, such as paints, varnishes, enamels, inks or suchlike, using the selective and controlled delivery of colored pigments, through a delivery head provided with one or more nozzles, even several dozen, it is known to provide a device which prevents the nozzles from drying, above all when the machine is not operating.

A device to prevent the nozzles in a dispensing machine for fluid coloring products from drying out is known from the American patent U.S. Pat. No. 5,842,641, which comprises a cup element horizontally mobile between an inactive position, distant from the delivery head, and an operating position in which it is in contact with the delivery head. A buffer disc of absorbent material, impregnated with water or a solvent, is disposed in the cup element. The buffer disc is vertically mobile between an inactive position, distant from the nozzles, and an operating position, near to the tips of the latter, in order to create a humidifying chamber with a reduced volume.

This known device, however, has the disadvantage that it is rather complex, because it needs two movement mechanisms, one to move the cup element horizontally and the other to move the buffer disc vertically.

Another device to prevent the nozzles in a machine to prepare fluid coloring products from drying out is described in WO 2005/107956A1 in the name of the Applicant. This device comprises elements for conveying a stream of air in the zone under the nozzles in order to create a different atmosphere from the environmental atmosphere, and to determine conditions which do not cause the nozzles to dry out when they are in their non-operating condition. The device also comprises a covering element for the delivery head, which is applied to selectively create a closed chamber with controlled atmosphere around the head, normally when the machine is in a non-operating condition for a certain time. The cover does not in fact function as an anti-drying member but only to close the chamber in which the desired atmosphere has been created by a controlled stream of air.

BRIEF SUMMARY OF THE INVENTION

One purpose of the present invention is to obtain a device to prevent the drying of the nozzles of a machine to prepare fluid coloring products which is simple, reliable and inexpensive.

Another purpose of the present invention is to obtain a device to prevent the drying of the nozzles of a machine to prepare fluid coloring products which is commanded by a single actuation mechanism to pass from an inactive position to an operating position.

Another purpose of the present invention is to obtain a device to prevent the drying of the nozzles of a machine to prepare fluid coloring products in which, in the operating position, the airtight seal between the delivery head and a corresponding closing member is guaranteed in a simple and mechanical manner.

The Applicant has devised, tested and embodied the present invention to overcome the shortcomings of the state of the art and to obtain these and other purposes and advantages.

The present invention is set forth and characterized in the independent claim, while the dependent claims describe other characteristics of the invention or variants to the main inventive idea.

This new and original technical solution, which achieves said purposes and offers surprising and unexpected advantages, both in technical terms and in terms of lower costs, provides to make a device to prevent the drying of nozzles of a machine to prepare fluid coloring products having a delivery head provided with said nozzles. The device comprises an anti-drying member, for example like a cup or a glass, suitable to be selectively taken from an inactive position, in which it is distanced from the delivery head, to an operating position, in which it is in contact with a lower surface of the latter. An actuation mechanism is suitable to effect the movement of the anti-drying member from the inactive position to the operating position.

In accordance with a main characteristic of the present invention, the anti-drying member comprises a cup or glass element inside which there is a liquid or an element impregnated with a liquid, and the actuation mechanism comprises an actuation lever oscillating with respect to a fixed support and a group of parallelogram levers commanded by the actuation lever and connected to the anti-drying member so as to maintain an upper surface of the latter constantly parallel to the lower surface of the delivery head during the movement from the inactive position to the operating position.

In this way, with a single actuation mechanism, which can be commanded manually or more advantageously by an electric motor, the effect of positioning the anti-drying member in contact with the delivery head in which the ends of the delivery nozzles are positioned is obtained simply and effectively.

Moreover, in accordance with a secondary characteristic of the present invention, the actuation mechanism also comprises thrust means interposed between the actuation lever and the group of parallelogram levers to apply a predetermined force to the anti-drying member when the latter is in the operating position, in order to guarantee an airtight seal between the anti-drying member and the delivery head.

Moreover, in accordance with a secondary characteristic of the present invention, the thrust means comprise at least a thrust lever pivoted on the actuation lever and kept constantly in contact with at least a first lever of the group of parallelogram levers, and an elastic element, which can be for example a traction spring, which connects the thrust lever to the actuation lever.

BRIEF DESCRIPTION OF THE SEVERAL VIEWS OF THE DRAWINGS

These and other characteristics of the present invention will become apparent from the following description of a preferential form of embodiment, given as a non-restrictive example with reference to the attached drawings wherein.

DETAILED DESCRIPTION OF THE INVENTION

Figure 1:
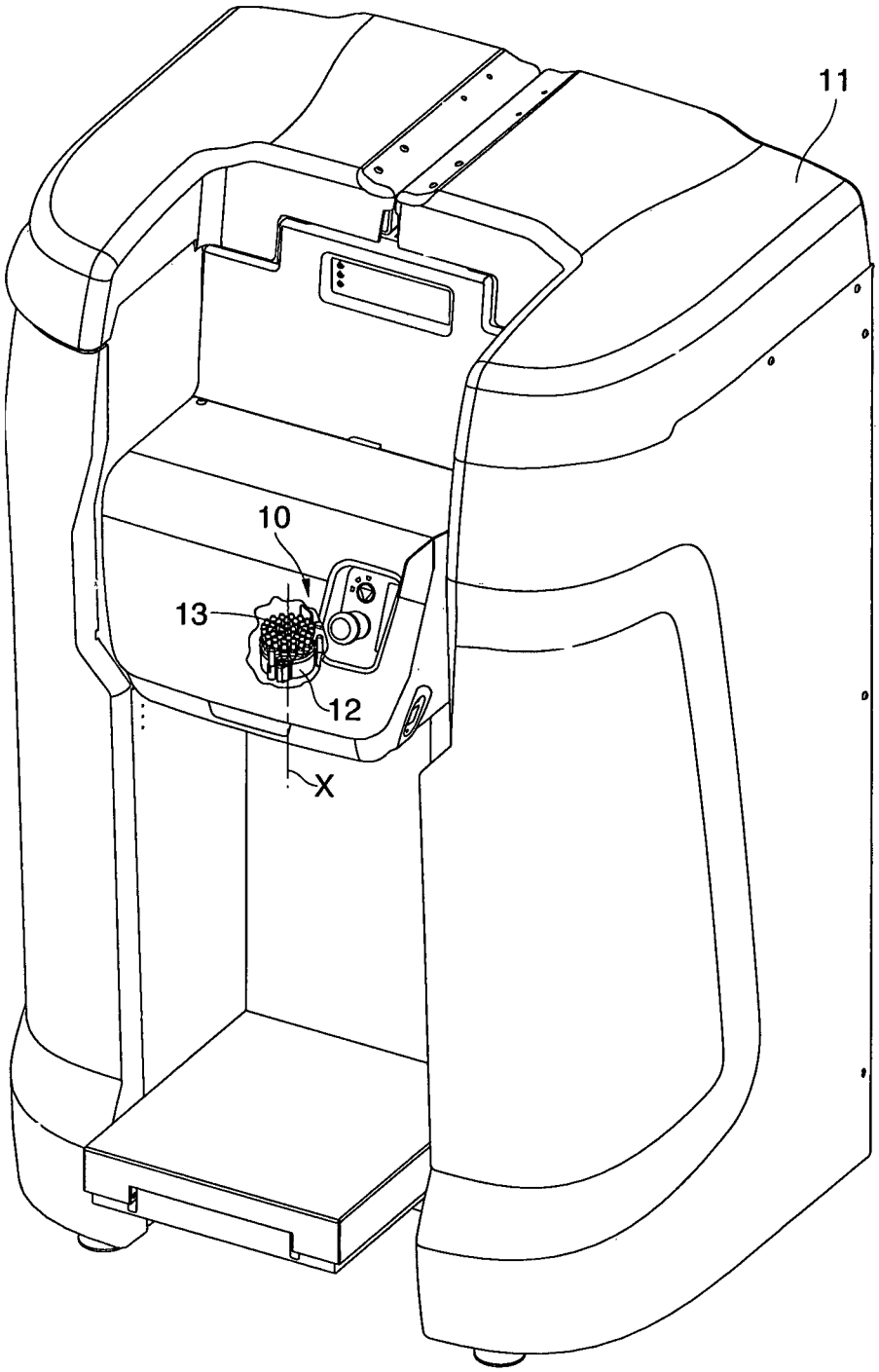
FIG. 1 is a perspective and schematic view of a machine to prepare fluid coloring products, in which a device according to the present invention is mounted to prevent the drying of the nozzles of the machine.
Figure 2:
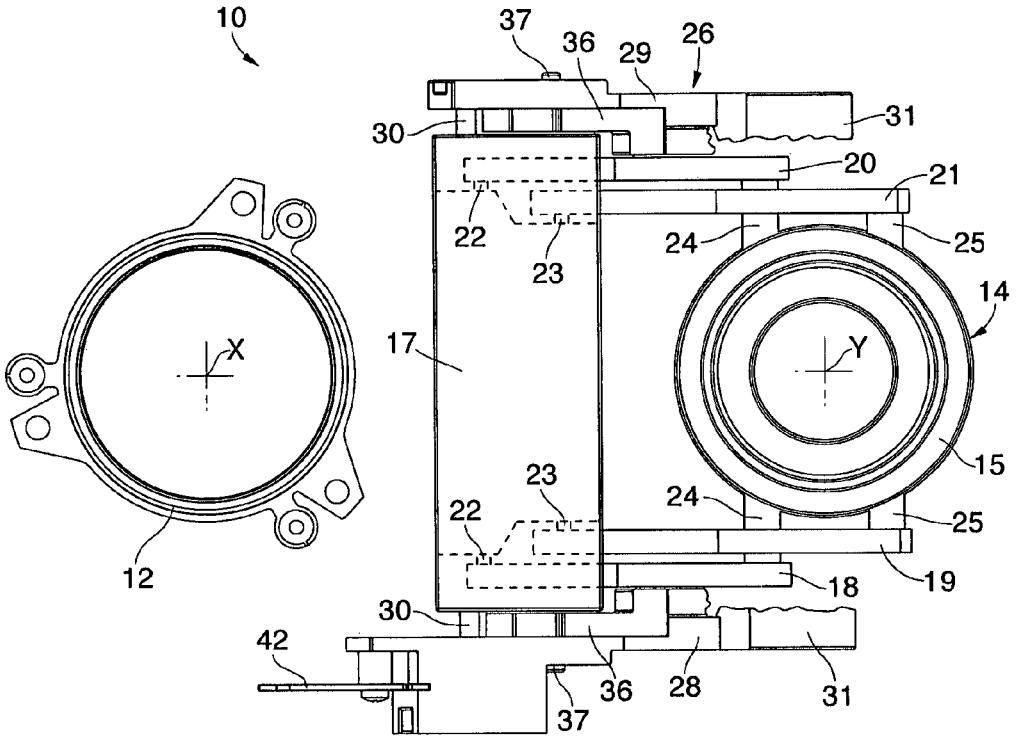
FIG. 2 is a plan view, partly sectioned, of the device according to the present invention in an inactive position.

With reference to FIGS. 1 and 2, a device 10 according to the present invention is suitable to be mounted on a machine 11 to prepare fluid coloring products. The machine 11 can be of any known type or one that will be developed in the future, and comprises a delivery head 12 with one or more delivery nozzles 13. The device 10 is suitable to prevent the delivery nozzles 13 from drying out.

For example, the machine 11 can be the type described in the international patent application WO-A-2011/161532, or in the Italian patent application for industrial inventions IT-UD2012A000126.

The device 10 (FIGS. 2-8) comprises a cup, or glass, element 14, mobile between an inactive position (FIGS. 2, 3 and 7), in which it is distant from the delivery head 12 and almost coplanar to it, and an operating position (FIGS. 4 and 8), in which it has an upper surface 15 in contact with a lower surface 16 of the delivery head 12 and coaxial to it.

The cup element 14 is suitable to function as an anti-drying member, it normally contains a sponge impregnated with a liquid, for example water or a solvent, and has an upper surface 15 disposed horizontally.

Moreover, the cup element 14 is moved in such a way that its upper surface 15 remains constantly horizontal, that is, its central axis Y is always parallel to the central axis X of the delivery head 12.

This happens because the cup element 14 is connected to a support block 17, which functions as a pivoting support, mounted in a fixed position on a structure of the machine 11, by means of two pairs of levers 18 and 19, respectively 20 and 21, disposed so as to form two parallelograms.

The two parallelograms formed by the levers 18 and 19, 20 and 21, are parallel to each other (FIGS. 2 and 6) and are disposed one on one side and one on the other side of the same support block 17. Moreover, the levers 18, 19, 20 and 21 are offset with respect to each other on different vertical planes so as not to interfere with each other.

In particular, one end of each of the levers 18 and 20 (denominated first levers) is pivoted on a corresponding first pin 22. The two first pins 22 are coaxial to each other. Similarly, one end of each of the levers 19 and 21 (denominated second levers) is pivoted on a corresponding second pin 23. The two second pins 23 are coaxial to each other. Moreover, the pins 22 and 23 are supported in the lower part of the support block 17 and lie on the same horizontal plane.

Another end of each of the first levers 18 and 20 is rotatable on a corresponding first peg 24 of a lower independent support 43, on which the cup element 14 is mounted, for example with a bayonet type coupling.

The two first pegs 24 are coaxial to each other. Similarly, another end of each of the second levers 19 and 21 is connected to a corresponding second peg 25, which is also solid to the lower support 43. The two second pegs 25 are coaxial to each other and lie on the same horizontal plane on which the first pegs 24 also lie.

Figure 7:
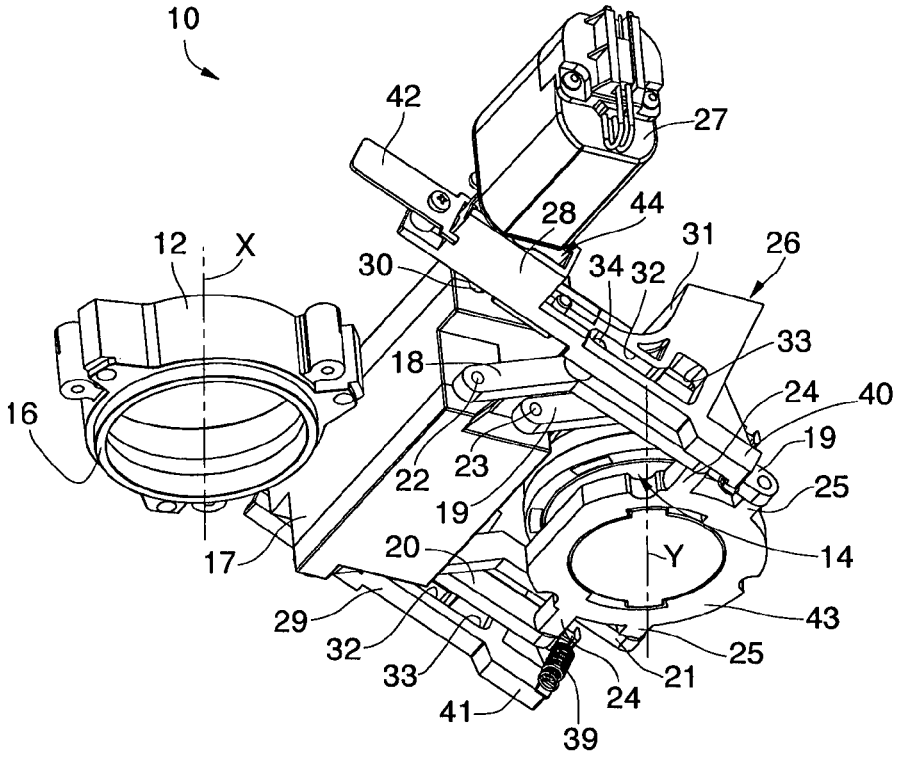
FIG. 7 is a perspective view from below of the device according to the present invention in an inactive position.
Figure 8:
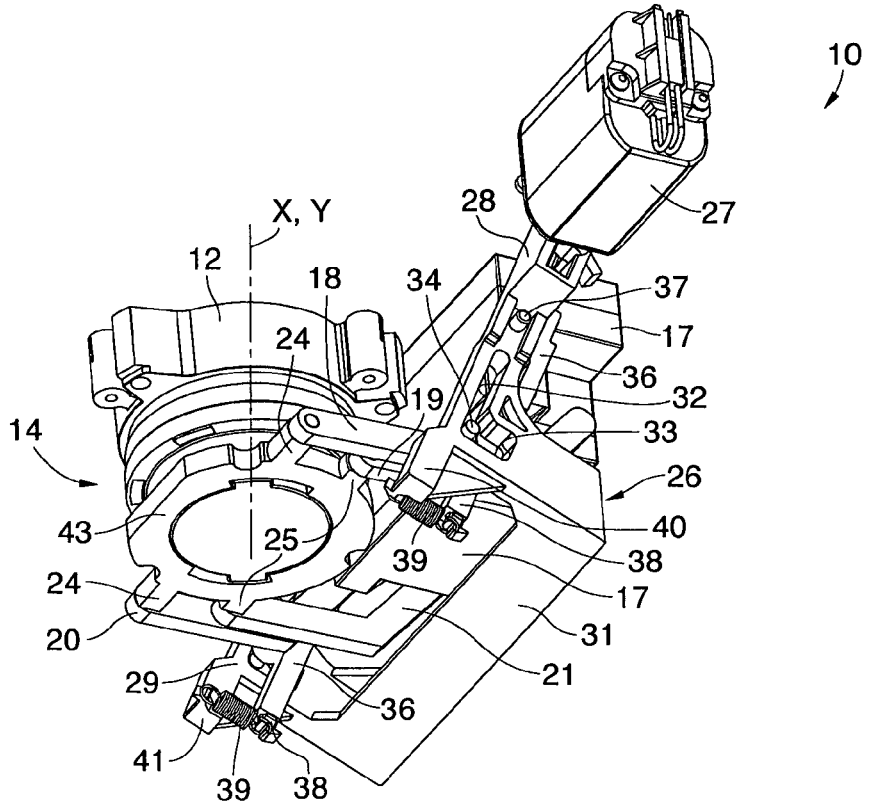
FIG. 8 is a perspective view from below of the device according to the present invention in an operating position.

The selective movement of the cup element 14 from the inactive position (FIGS. 2, 6 and 7) to the operating one (FIGS. 4 and 8), and vice versa, is carried out by an actuation mechanism, which comprises an actuation lever 26 commanded by an electric motor 27 of the reversible type (FIGS. 7 and 8). The electric motor 27 can be any known type, of the continuous current type for example and provided with a gear motor with a command lever, not shown in the drawings, which enters into a corresponding seating 44 (FIG. 7) of the actuation lever 26. The electric motor 27 too, like the support block 17, is mounted in a fixed position on a structure of the machine 11.

The actuation lever 26 (FIGS. 2, 7 and 8) has a substantially forked U-shape and comprises two lateral arms 28 and 29, disposed on opposite sides with respect to the support block 17 and externally with respect to the levers 18, 19, 20 and 21. The two lateral arms 28 and 29 are pivoted on third pins 30, coaxial to each other and at the exit of the electric motor 27. The third pins 30 are supported in the upper part of the support block 17. The two lateral arms 28 and 29 of the actuation lever 26 are connected to each other by a connection bar 31 disposed in a position that does not interfere with the levers 18, 19, 20 and 21.

Each lateral arm 28 and 29 is provided with an eyelet 32, having a rectilinear segment and a widened terminal part 33, so that each eyelet 32 is substantially L-shaped.

Two corresponding command pegs 34 are inserted sliding and without play into the two eyelets 32 which are parallel to each other. The two command pegs 34 are coaxial to each other and are attached one to the lever 18 and the other to the lever 20. Moreover, each command peg 34 has a portion 35 with a bigger diameter than that of the part which is inside the corresponding eyelet 32. The portions 35 of the command pegs 34 are outside the eyelets 32.

Each portion 35 of the two command pegs 34 with the bigger diameter cooperates constantly with a corresponding thrust lever 36.

The two thrust levers 36 are parallel to each other and are pivoted on two pins 37, coaxial to each other and supported by the lateral arms 28 and 29 of the actuation lever 26.

At one end 38 of each thrust lever 36 a head of a helical spring 39 is attached. The other heads of the two helical springs 39 are attached to two ends 40 and 41 of the two lateral arms 28 and 29 of the actuation lever 26.

In this way the two helical springs 39 constantly hold the two thrust levers 36 against the portions 35 of the command pegs 34 of the levers 18 and 20.

A fin 42, with the function of indicating the angular position of the actuation lever 26, is constrained at one end of the lateral arm 28, in proximity to the electric motor 27, in order to cooperate with two proximity sensors, of a known type and not shown in the drawings, one in the inactive position and the other in the operating position.

The device 10 as described heretofore functions as follows.

When the delivery head 12 is operating, the device 10 is maintained by the electric motor 27 in the inactive position (FIGS. 2, 6 and 7), with the cup element 14 distant from the delivery head 12.

Figure 3:
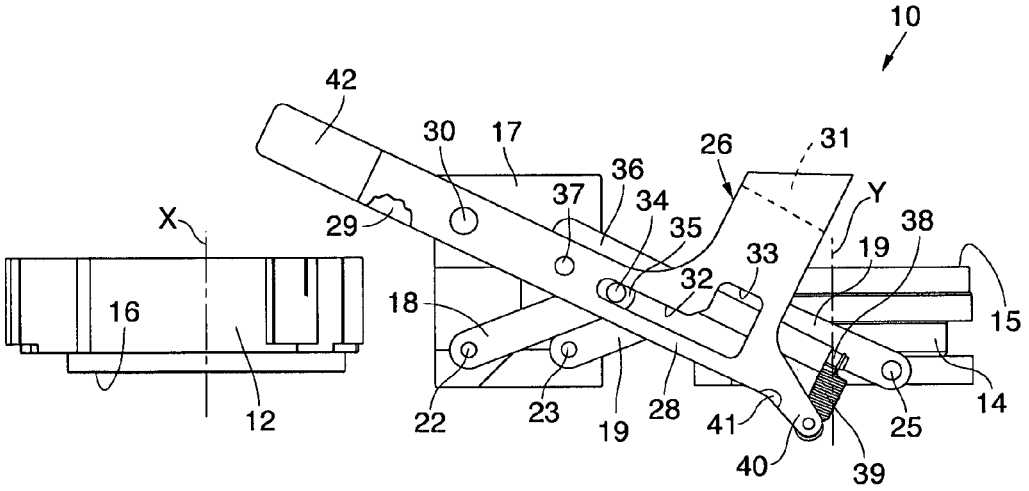
FIG. 3 is a schematized lateral view of the device in FIG. 2.
Figure 4:
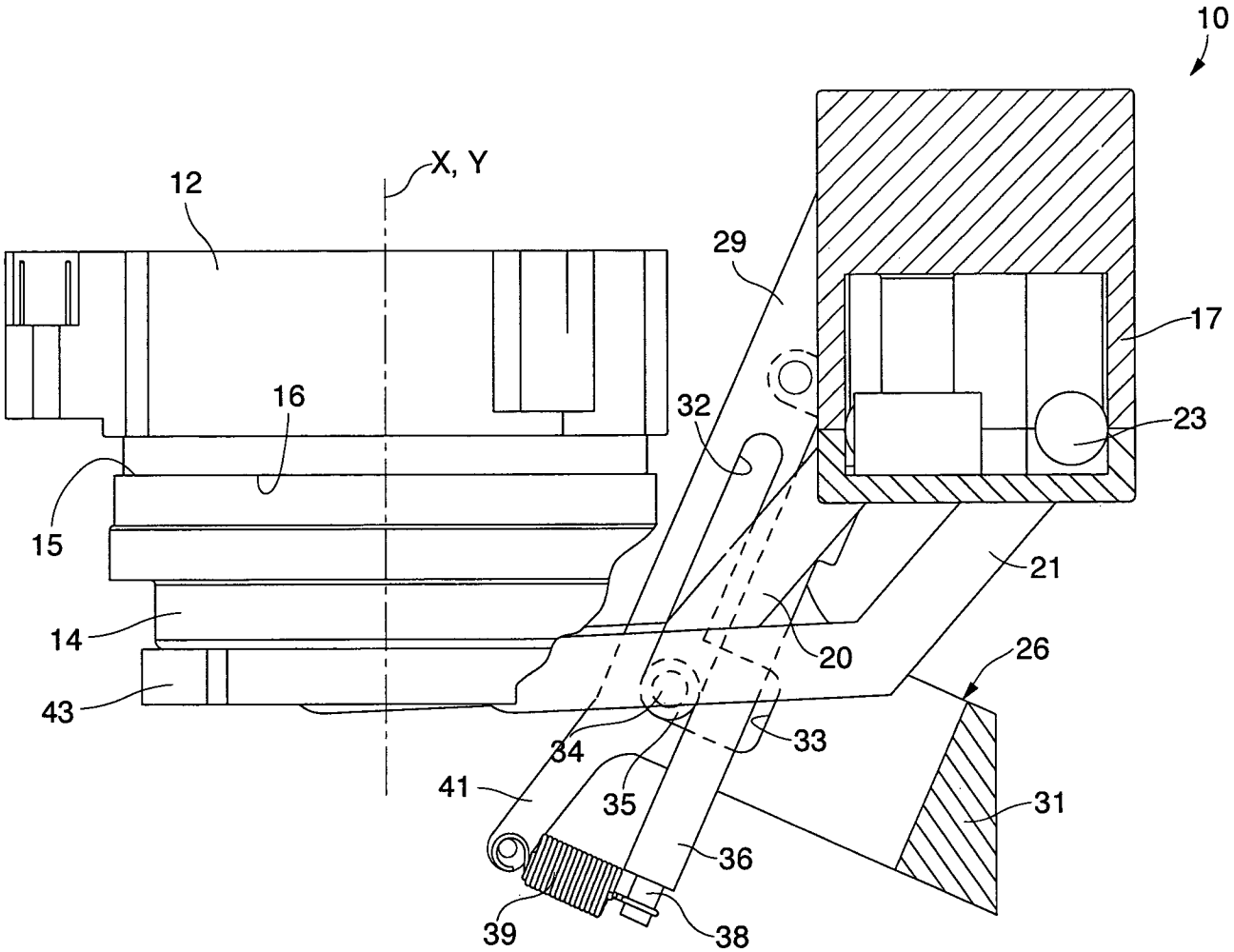
FIG. 4 is a schematized lateral view of the device according to the present invention in an operating position.
Figure 5:
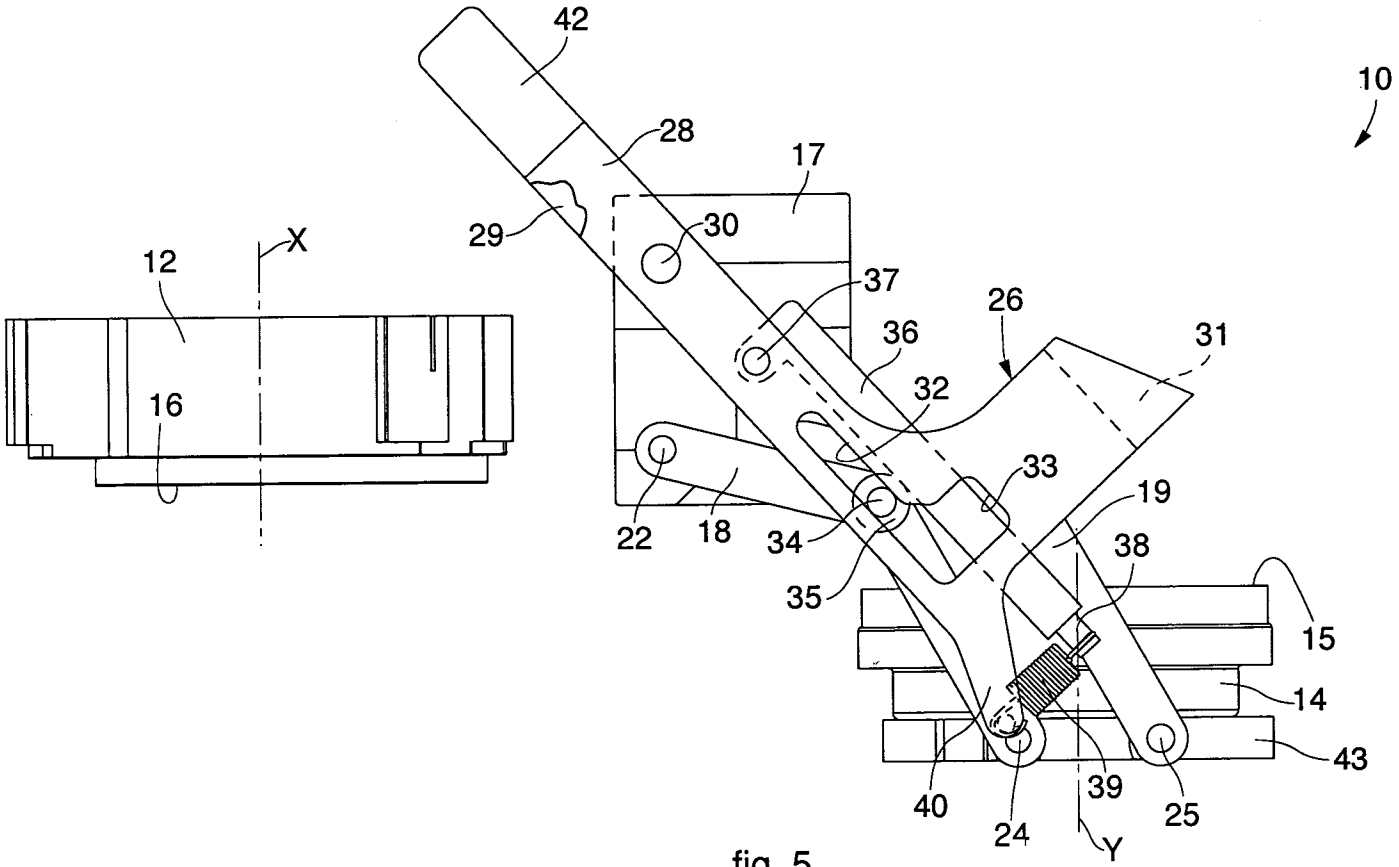
FIG. 5 is a schematized lateral view of the device according to the present invention in an intermediate position between the inactive position of FIG. 3 and the operating position of FIG. 4.
Figure 6:
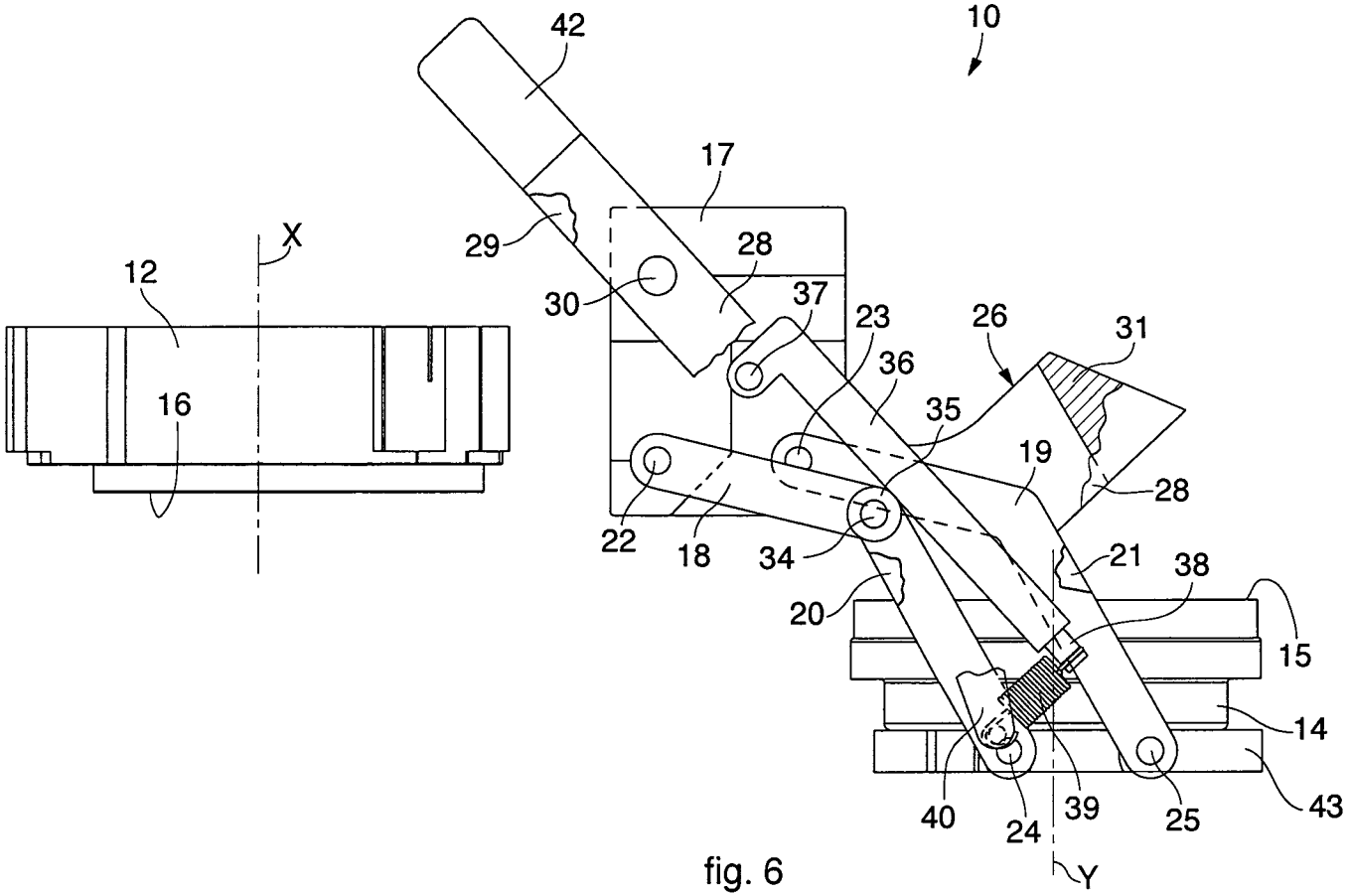
FIG. 6 is a schematized lateral and partly sectioned view of the device in FIG. 5, which shows some of its components in detail.

When the delivery head 12 has terminated one delivery step and no others are provided within a determinate period of time, in order to prevent the tips of the delivery nozzles 13 from drying out, the electric motor 27 is driven so that the actuation lever 26 completes a rotation in a clockwise direction of about 85° (FIGS. 3 and 4).

With this rotation of the actuation lever 26, by means of the two command pegs 34, inserted into the two eyelets 32, the levers 18 and 20 are thrust, so that the four levers 18, 19, 20 and 21 are rotated in a clockwise direction, until the upper surface 15 of the cup element 14 comes into contact with the lower surface 16 of the delivery head 12 (FIG. 4).

To guarantee a perfect airtight seal between the two surfaces 15 and 16 the electric motor 27 makes the actuation lever 26 perform a further rotation of some degrees, for example from 1 to 5°.

This further rotation does not, however, make the four levers 18, 19, 20 and 21 rotate further, but makes the two command pegs 34 become detached from the walls of the corresponding terminal parts 33 of the eyelets 32. However, on the portions 35 of the command pegs 34 the thrust levers 36 continue to press, pulled by the helical springs 39 which have been stretched and which thus apply a predetermined and constant force to the first levers 18 and 20, and therefore also to the cup element 14 connected thereto, which guarantees the airtight seal.

When a new delivery step is to be carried out by the delivery head 12, the electric motor 27 is driven in the opposite direction, so that the actuation lever 26 performs a rotation in an anti-clockwise direction of about 86°-90° until it returns to the inactive position (FIG. 3).

It is clear that modifications and/or additions of parts may be made to the device 10 as described heretofore, without departing from the field and scope of the present invention.

It is also clear that, although the present invention has been described with reference to some specific examples, a person of skill in the art shall certainly be able to achieve many other equivalent forms of device to prevent the of nozzles in machines to prepare fluid coloring products, having the characteristics as set forth in the claims and hence all coming within the field of protection defined thereby.

The invention claimed is:

1. A device to prevent the drying of nozzles of a machine for the preparation of fluid coloring products having a delivery head provided with said nozzles, said device comprising an anti-drying member suitable to be selectively taken from an inactive position, in which the anti-drying member is distanced from said delivery head, to an operating position, in which the anti-drying member is in contact with a lower surface of said delivery head, and an actuation mechanism suitable to effect the movement of said anti-drying member from said inactive position to said operating position, wherein said anti-drying member comprises a cup or glass element inside which there is a liquid or an element impregnated with a liquid, and wherein said actuation mechanism comprises an actuation lever oscillating with respect to a fixed support and a group of parallelogram levers commanded by said actuation lever and connected to said anti-drying member so as to keep an upper surface of said anti-drying member constantly parallel to said lower surface of said delivery head during the movement from said inactive position to said operating position;

wherein when said delivery head is operating, the anti-drying member is maintained in the inactive position with the cup or glass element distanced from the delivery head, and wherein when the delivery head has terminated a delivery step, the anti-drying member is actuated to position the upper surface of said anti-drying member in contact with the lower surface of said delivery head;

wherein the device further comprises thrust means interposed between said actuation lever and said group of parallelogram levers to apply a predetermined force to said anti-drying member when said anti-drying member is in said operating position, in order to guarantee an airtight seal between said anti-drying member and said delivery head; and wherein said thrust means comprise at least one thrust lever pivoted on said actuation lever and kept constantly in contact with at least one first lever of said group of parallelogram levers, and an elastic element which connects said at least one thrust lever to said actuation lever.

2. The device as in claim 1, wherein said fixed support comprises a pivoting block on which both said actuation lever and said group of parallelogram levers are pivoted.

3. The device as in claim 1, wherein an electric motor of the reversible type is mounted in a fixed position and is connected to said actuation lever to make said actuation lever selectively carry out rotations in a clockwise direction and in an anti-clockwise direction with respect to said fixed support.

4. The device as in claim 1, wherein said elastic element comprises a helical spring stretched between one end of said at least one thrust lever and one end of said actuation lever.

5. The device as in claim 1, wherein said actuation lever comprises at least an arm provided with an eyelet in which a command pin attached to said at least one first lever of said group of parallelogram levers is able to slide with precision.

6. The device as in claim 5, wherein a terminal part of said eyelet is widened, so that said eyelet is substantially L-shaped, and wherein said command pin is suitable to be in said terminal part when said anti-drying member is in said operating position.

7. The device as in claim 5, wherein said command pin comprises a portion with a bigger diameter than a part of the command pin which is in said eyelet and is constantly in contact with said thrust lever.

8. The device as in claim 1, wherein said element impregnated with a liquid is a sponge.

9. A device to prevent the drying of nozzles of a machine for the preparation of fluid coloring products having a delivery head provided with said nozzles, said device comprising an anti-drying member suitable to be selectively taken from an inactive position, in which the anti-drying member is distanced from said delivery head, to an operating position, in which the anti-drying member is in contact with a lower surface of said delivery head, and an actuation mechanism suitable to effect the movement of said anti-drying member from said inactive position to said operating position, wherein said anti-drying member comprises a cup or glass element inside which there is a liquid or an element impregnated with a liquid, wherein said actuation mechanism comprises an actuation lever oscillating with respect to a fixed support and a group of parallelogram levers commanded by said actuation lever and connected to said anti-drying member so as to keep an upper surface of said anti-drying member constantly parallel to said lower surface of said delivery head during the movement from said inactive position to said operating position, and wherein at least one thrust lever is pivoted on said actuation lever and is connected thereto via an elastic element such that the at least one thrust lever is kept constantly in contact with at least one first lever of said group of parallelogram levers so as to apply a predetermined force to said anti-drying member when said anti-drying member is in said operating position in order to guarantee an airtight seal between said anti-drying member and said delivery head.

10. The device of claim 3, wherein the electric motor drives the actuation lever to perform a first rotation such that the upper surface of the anti-drying member contacts the lower surface of the delivery head, and wherein the electric motor further rotates the actuation lever to guarantee an airtight seal between the upper surface of the anti-drying member and the lower surface of the delivery head without further rotation of the group of parallelogram levers.

11. The device of claim 1, wherein said at least one thrust lever is kept constantly in direct contact with at least one first lever of said group of parallelogram levers.

12. The device as in claim 9, wherein said fixed support comprises a pivoting block on which both said actuation lever and said group of parallelogram levers are pivoted.

13. The device as in claim 9, wherein an electric motor of the reversible type is mounted in a fixed position and is connected to said actuation lever to make said actuation lever selectively carry out rotations in a clockwise direction and in an anti-clockwise direction with respect to said fixed support.

14. The device as in claim 9, wherein said elastic element comprises a helical spring stretched between one end of said at least one thrust lever and one end of said actuation lever.

15. The device as in claim 9, wherein said actuation lever comprises at least an arm provided with an eyelet in which a command pin attached to said at least one first lever of said group of parallelogram levers is able to slide with precision.

16. The device as in claim 15, wherein a terminal part of said eyelet is widened, so that said eyelet is substantially L-shaped, and wherein said command pin is suitable to be in said terminal part when said anti-drying member is in said operating position.

17. The device as in claim 15, wherein said command pin comprises a portion with a bigger diameter than a part of the command pin which is in said eyelet and is constantly in contact with said thrust lever.

18. The device as in claim 9, wherein said element impregnated with a liquid is a sponge.

19. The device of claim 13, wherein the electric motor drives the actuation lever to perform a first rotation such that the upper surface of the anti-drying member contacts the lower surface of the delivery head, and wherein the electric motor further rotates the actuation lever to guarantee an airtight seal between the upper surface of the anti-drying member and the lower surface of the delivery head without further rotation of the group of parallelogram levers.

20. The device of claim 9, wherein said at least one thrust lever is kept constantly in direct contact with at least one first lever of said group of parallelogram levers.

* * * * *